US008397829B2

(12) United States Patent
Brown

(10) Patent No.: US 8,397,829 B2
(45) Date of Patent: Mar. 19, 2013

(54) COAL FIRE EXTINGUISHMENT METHOD AND APPARATUS

(76) Inventor: Walter Allan Brown, Panama City Beach, FL (US)

( * ) Notice: Subject to any disclaimer, the term of this patent is extended or adjusted under 35 U.S.C. 154(b) by 164 days.

(21) Appl. No.: 13/082,823

(22) Filed: Apr. 8, 2011

(65) Prior Publication Data

US 2012/0255745 A1 Oct. 11, 2012

(51) Int. Cl.
*A62C 2/00* (2006.01)

(52) U.S. Cl. ..... 169/46; 169/64

(58) Field of Classification Search ..... 169/43, 169/46, 48, 49, 64, 70
See application file for complete search history.

(56) References Cited

U.S. PATENT DOCUMENTS

| | | | | | |
|---|---|---|---|---|---|
| 2,202,343 | A * | 5/1940 | Geertz | 169/11 |
| 2,352,278 | A * | 6/1944 | Manley | 409/240 |
| 2,352,378 | A * | 6/1944 | Geertz | 169/44 |
| 2,506,126 | A * | 5/1950 | Williamson et al. | 169/5 |
| 2,732,800 | A * | 1/1956 | Coursen | 102/326 |
| 3,421,587 | A * | 1/1969 | Jones et al. | 169/46 |
| 4,641,711 | A * | 2/1987 | Terry | 169/44 |
| 5,188,186 | A * | 2/1993 | Nash | 169/48 |
| 5,299,646 | A * | 4/1994 | Courtney | 169/52 |
| 5,368,105 | A * | 11/1994 | Chaiken et al. | 169/44 |
| 5,425,886 | A * | 6/1995 | Smith | 252/5 |
| 5,450,906 | A * | 9/1995 | Courtney | 169/46 |
| 5,909,777 | A * | 6/1999 | Jamison | 169/43 |
| 7,104,336 | B2 * | 9/2006 | Ozment | 169/44 |
| 7,334,644 | B1 * | 2/2008 | Ozment | 169/46 |
| 2004/0216901 | A1 * | 11/2004 | Edwards et al. | 169/47 |
| 2011/0127051 | A1 * | 6/2011 | Guse | 169/46 |

* cited by examiner

*Primary Examiner* — Christopher Kim
(74) *Attorney, Agent, or Firm* — J. Wiley Horton

(57) ABSTRACT

A method and apparatus for controlling and extinguishing subterranean coal fires. Suitable detection and measuring devices are initially used to determine the extent of the fire and develop a plan of extinguishment. Flow control devices are added to all the mine's access points in order to control gas flow into and/or out of the mine. In addition, new access points may be added. Gaseous carbon dioxide is pumped into the mine until a positive pressure is developed (with respect to atmospheric pressure. Pressurized and liquefied carbon dioxide is directed into the area of the combustion face. The liquid carbon dioxide blankets the combustion area with a gas which will not support combustion and absorbs a tremendous amount of heat from the burning coal.

20 Claims, 7 Drawing Sheets

COAL FIRE EXTINGUISHMENT METHOD AND APPARATUS

CROSS-REFERENCES TO RELATED APPLICATIONS

Not Applicable.

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of subterranean coal fires. More specifically, the invention comprises a method and apparatus for controlling the temperature and oxygenation of a coal fire in order to bring it under control and ultimately extinguish it.

2. Description of the Related Art

Coal remains one of the earth's most important natural resources. A substantial amount of this resource is wasted via the burning of the coal in situ. Coal fires occur in a variety of ways. FIG. 1 shows a coal fire occurring in a seam which intersects the surface. Coal seam 10 slopes upward toward surface 12. A portion of the seam is exposed to the surface. The exposed portion is ignited via a brush fire or other source. Combustion face 14 forms. The combustion face is typically a narrow band of burning coal advancing into the seam.

Collapsed cover 20 falls over the combustion face as it burns. Ground collapse 16 also falls over the combustion face as the support burns away beneath soil/sediment 24. Air 18 is drawn toward the combustion face as the hot combustion products rush upwards. The combustion process itself is often smoldering combustion, since the overlying collapsed cover restricts the oxygen supply.

The rate of combustion typically slows as the combustion face progresses further and further underground. However, the combustion of the seam promotes further grounds collapse and this process generally creates additional ventilation. Thus, the combustion face may continue until it exhausts the seam, encounters the water table, or progresses so deep into the earth that it is starved of oxygen. It is not unusual for such a fire to continue for decades and—in extreme cases—even centuries.

A coal fire in a surface-intersecting seam may be fought conventionally if the fire is detected at its inception (by inundating the exposed portion with water). However, once the fire progresses underground it is very difficult to extinguish. Thus, although the fire starts as a surface fire if it continues it will become a subterranean fire.

Of course, subterranean fires also occur in seams which do not intersect the surface. Such fires are almost always the result of human activity. FIG. 2 shows a portion of a soft-rock subterranean mine. Coal seam 10 lies completely beneath surface 12 (in a layer of soft rock 26). Drift 32 (a horizontal passageway cut to follow the seam) is connected to the surface via ventilation shaft 28. There are typically multiple ventilation shafts in such a mine. There may also be natural vents 30 which connect to the surface.

In the example shown the mining activity has produced a coal fire. Mining involves the use of explosives, the use of arc welding, and other potential ignition sources. Mining may also produce a methane gas explosion and fire which—under certain circumstances—can ignite the coal being mined.

The existing passageways within a mine influence the flow of oxygen and waste gases. In the example of FIG. 2, air is drawn in through natural vent 30 and feeds the combustion process occurring along combustion face 14. Waste gases travel along drift 32 and out ventilation shaft 28. The flow of oxygen and waste gases is generally more complex than is illustrated.

In fighting the fire, efforts are often made to seal the mine so that the oxygen supply will be exhausted. However, most coal mines which are reasonably close to the surface have multiple natural vents. It is often quite difficult to find and cap all the natural vents. Of course, in attempting to eliminate all the oxygen from the mine, one also makes it more difficult for firefighters to work in the mine.

Coal mines are typically much more complex than the example shown in FIG. 2. FIG. 3 shows a plan view of a modestly sized coal mine of the room-and-pillar type. The reader should note that there are many types of coal mines. A description of all the different types of mines is beyond the scope of this disclosure and is—in any event—not necessary for the understanding of the present invention. The room-and-pillar type illustrated in FIG. 3 should therefore be viewed as only one example among many. The inventive methods described subsequently are potentially applicable to all types of mines.

FIG. 3 shows a coal mine 34 positioned to extract coal lying within coal seam boundary 48. Main shaft 36 descends from the surface. A smaller ventilation shaft 38 also descends from the surface. The two shafts are connected via drift 40. The coal removal works outward from drift 40. A number of crosscuts 42 extend perpendicularly from drift 40. Pillars 44 are left between the cross cuts in order to support the roof of the mine.

One or more ventilation bore holes 50 connect portions of the mine to the surface. These are often added as the crosscuts are extended in order to provide suitable ventilation in newly opened parts of the mine. Extraction boundary 46 defines the furthest extent of coal removal. The reader should bear in mind that the extraction boundary is generally being extended as work progresses. In the example of FIG. 3 the extraction process was started on the left side of the view and is working toward the right side.

FIG. 4 shows a sectional elevation view of the mine shown in FIG. 3. Shaft house 52 lies proximate (or over) the entrance to main shaft 36. The shaft house generally contains the hoisting gear which lowers the miners into the mine and extracts the mined material (though material is often extracted instead along a sloped conveyor). Vent shaft 38 is typically covered by a structure which contains ventilating blowers and various controls. Only one level of mining activity is shown. Multiple levels would typically be used to harvest coal from a seam such as is depicted in FIG. 4.

Coal fires are now recognized as a substantial source of greenhouse gas emissions (primarily $CO_2$). They also emit harmful pollutants such as mercury. Recent studies estimate that coal fires produce approximately 3% of all the earth's greenhouse gases. Land lying over such fires may be badly damaged by subsidence. The area around such fires is often rendered uninhabitable via the presence of atmospheric pollutants. Thus, coal fires are a highly destructive phenomenon.

In order to combat a subterranean coal fire, one must first determine its location and extent. There is no issue with detecting coal fires started by mining accidents—at least where the mining activity is licensed activity. However, many subterranean coal fires are started by pit mining in the third world. These fires are generally undocumented.

Detection of subterranean fires may be made by ground level temperature sensors and/or analysis of surface gases. Remote sensing using satellites or aircraft is more difficult. This is true because subterranean coal fires may only raise the surface temperature by 1 or 2 degrees Celsius. Larger variations are typically produced by sunlight versus shadow. However, combinations of surface temperature measurements with accurate subsidence measurements are often able to estimate the extent of a subterranean fire.

Once a fire's perimeter is established, the prior art approach to extinguishment involves (1) reducing the oxygen supply; and (2) drilling bore holes to inundate the fire with water and/or fly ash. Water is inadvisable in controlling fires in which the coal has a significant oxygen content—as the water can actually spread the fire. Fly ash is used for these. Some prior art proposals have also included inundating the fire with liquid nitrogen. The inherent expense of liquid nitrogen has made this approach unattractive. Thus, the prior art approaches have significant drawbacks.

It has long been known to use carbon dioxide to fight relatively small fires. Carbon dioxide could also be used to fight coal seam fires, but this has been impractical in the past owing to containerized carbon dioxide's high cost and limited availability. However, it is expected that carbon dioxide will become cheaper and more readily available in coming years. This will be the result of proposed carbon dioxide capture and storage schemes. Since this gas is now recognized as a type of pollutant (a greenhouse gas) governments around the world—in conjunction with industry—have proposed capturing and storing it instead of releasing it into the atmosphere. The present invention proposes to use carbon dioxide (preferably captured from industrial processes) to fight subterranean coal fires.

BRIEF SUMMARY OF THE INVENTION

The present invention comprises a method and apparatus for controlling and extinguishing subterranean coal fires. Suitable detection and measuring devices are initially used to determine the extent of the fire and develop a plan of extinguishment. Flow control devices are added to all the mine's access points in order to control gas flow into and/or out of the mine. In addition, new access points may be added.

Gaseous carbon dioxide is pumped into the mine until a positive pressure is developed (with respect to atmospheric pressure). The positive pressure prevents ingress of atmospheric oxygen. Pressurized and liquefied carbon dioxide is directed into the area of the combustion face. The effect of the liquid carbon dioxide is twofold. First, it blankets the combustion area with a gas which will not support combustion. Second, the phase change from a liquid to a gas absorbs a tremendous amount of heat from the burning coal.

Figure 1:
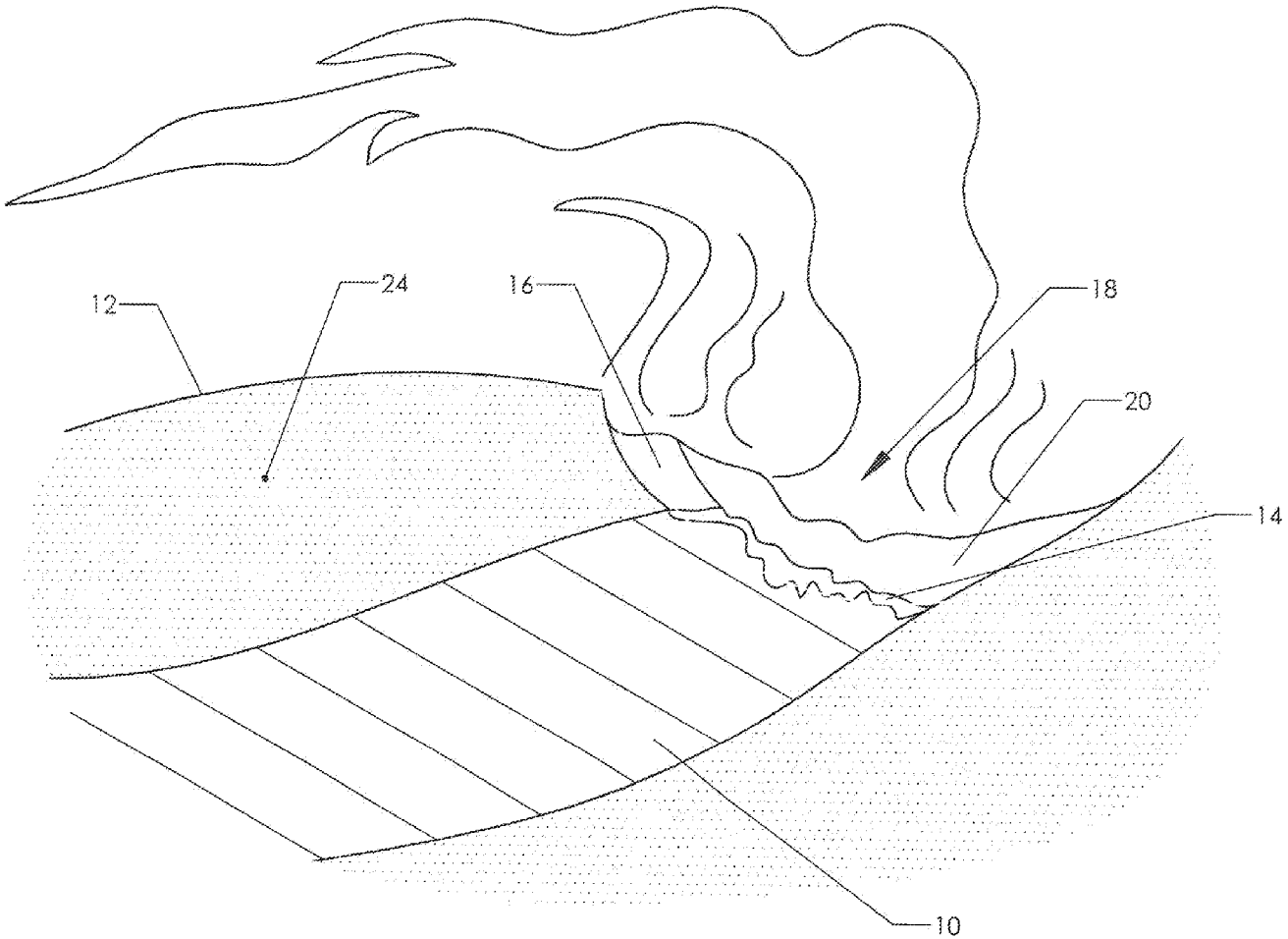
FIG. 1 (PRIOR ART)
FIG. 1 is a sectional elevation view, showing a coal seam burning near the surface.

| REFERENCE NUMERALS IN THE DRAWINGS | |
|---|---|
| 10 | coal seam |
| 12 | surface |
| 14 | combustion face |
| 16 | ground collapse |
| 18 | air |
| 20 | collapsed cover |
| 24 | soil/sediment |
| 26 | soft rock |
| 28 | ventilation shaft |
| 30 | natural vent |
| 32 | drift |
| 34 | coal mine |
| 36 | main shaft |
| 38 | ventilating shaft |
| 40 | drift |
| 42 | cross cut |
| 44 | pillar |
| 46 | extraction boundary |
| 48 | coal seam boundary |
| 50 | ventilation bore hole |
| 52 | shaft house |
| 54 | stop wall |
| 56 | cap |
| 58 | gaseous $CO_2$ supply |
| 60 | liquid $CO_2$ supply |
| 62 | controlled vent |
| 64 | monitor |
| 66 | bore hole |
| 68 | liquid injector head |
| 70 | gas injector head |
| 72 | monitor hole |
| 74 | surface monitor |
| 76 | purge pump |

DETAILED DESCRIPTION OF THE INVENTION

The present invention uses carbon dioxide in gaseous and liquid form. These substances are injected into a subterranean volume that has been sealed (or at least sealed as perfectly as possible). It is not necessary to use the largely pure carbon dioxide that presently results from industrial gas production. Instead, it is possible to use stored combustion exhaust products.

One example is to harvest carbon dioxide from coal-fired electrical generating plants. This impurities contained in this gas (such as sulfur, nitrogen, and even some oxygen) are often removed at the point of emission (using scrubbers, etc.). Relatively pure carbon dioxide is thus produced and this is preferred for the present invention. However, even carbon dioxide containing significant impurities can be used for the present invention (though its use may affect the monitoring process, as will be explained subsequently).

Figure 2:
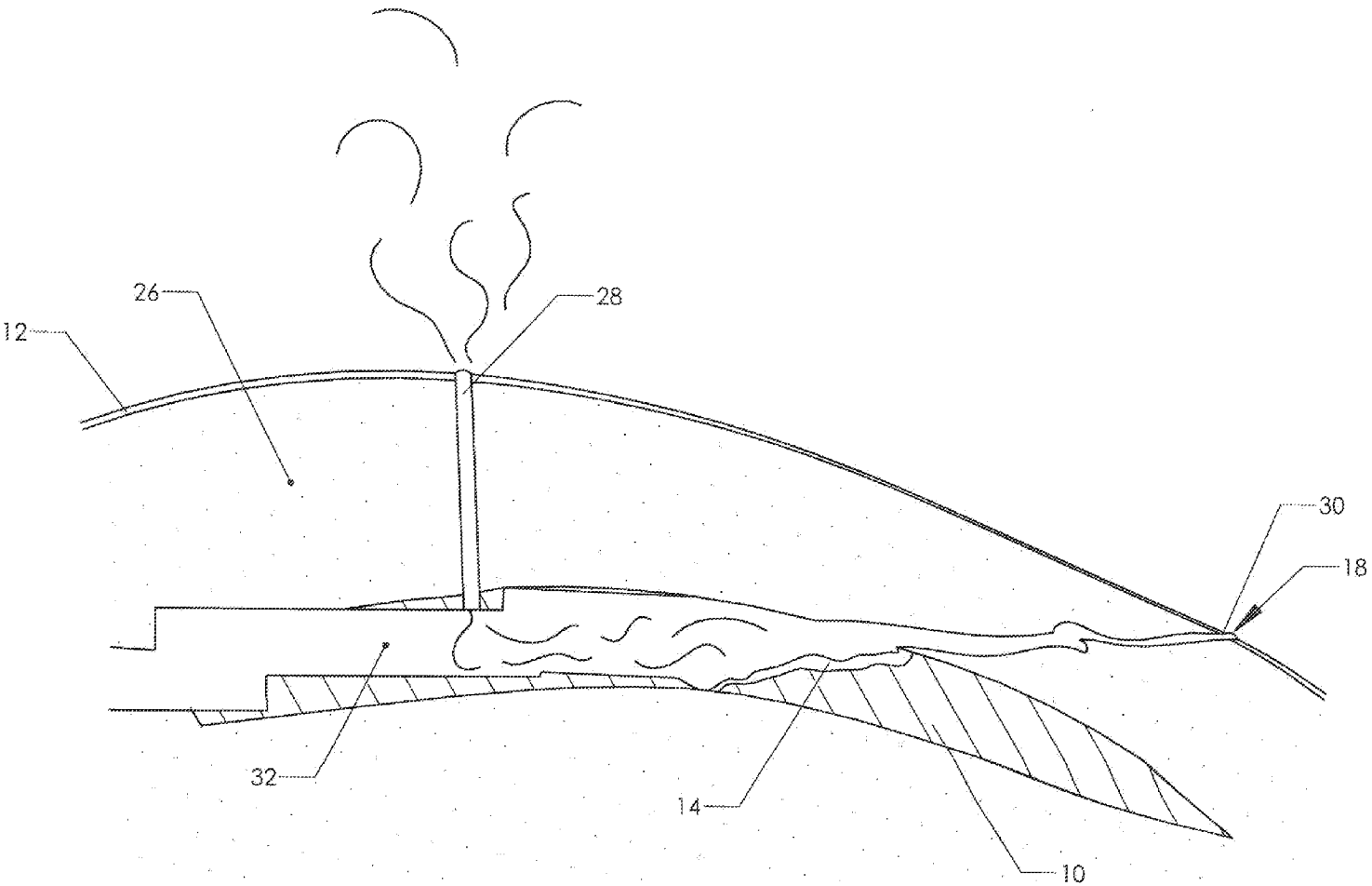
FIG. 2 (PRIOR ART)
FIG. 2 is a sectional elevation view, showing a subterranean coal mine with a natural vent.
Figure 5:
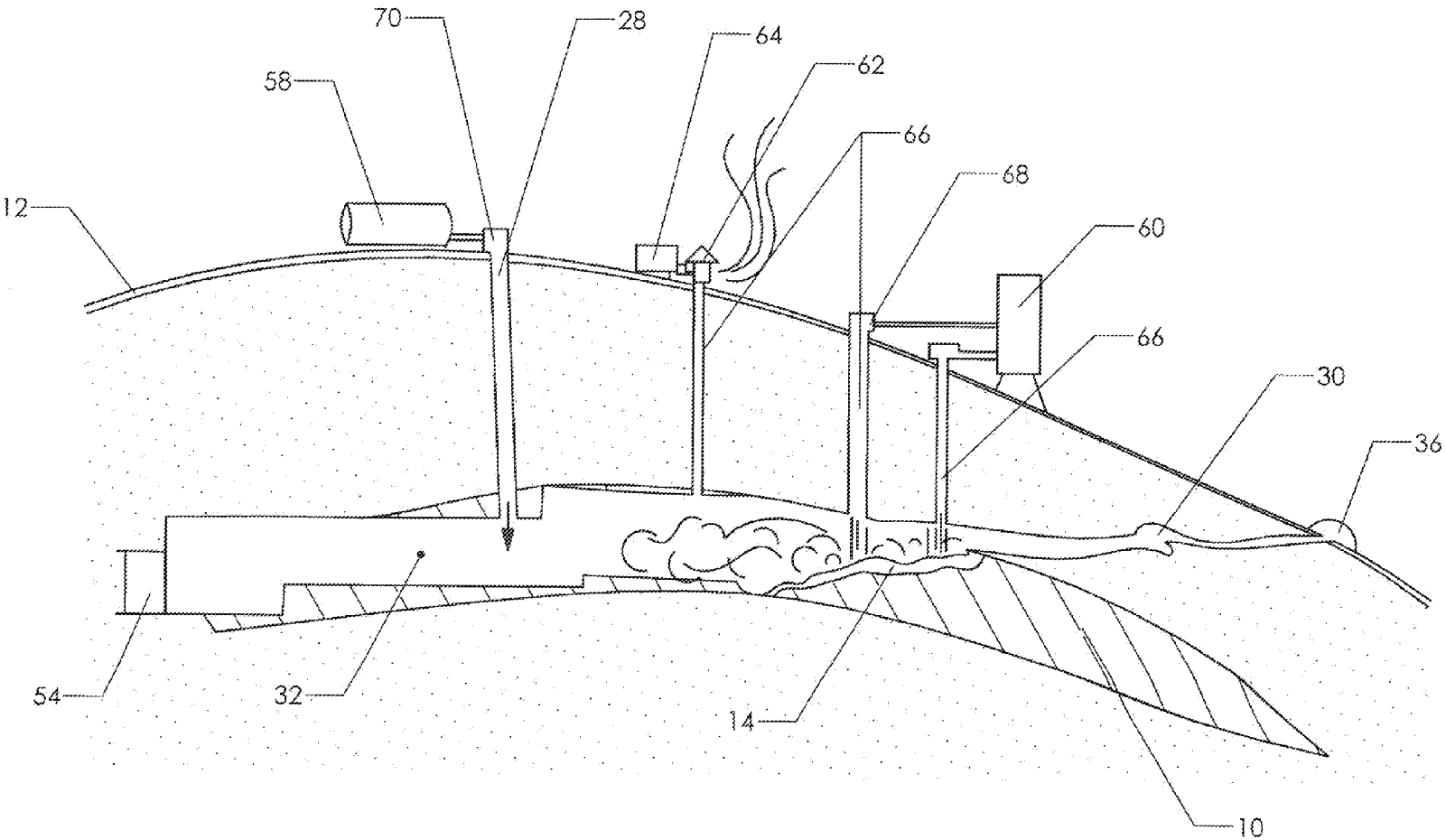
FIG. 5 is a sectional elevation view, showing the application of the present invention to a subterranean coal fire in the mine depicted in FIG. 2.

FIG. 5 shows a subterranean mine as previously shown in FIG. 2. The location of combustion face 14 is initially determined and a plan to fight the fire is formed. A subterranean volume containing the fire is defined. This volume will generally be less than the entire mine, so the defined volume must be segregated from the whole.

In the example of FIG. 5, stop wall 54 has been placed in drift 32. One way to place such a stop wall is to form and pour concrete with an included portal. The portal includes a pressure-tight hatch that can be closed and sealed at the appropriate time.

Next, every ventilation access port to the subterranean volume should be found. A "ventilation access port" is any route whereby the subterranean volume is connected to the surface. For example, ventilation shaft 28 and natural vent 30 are both ventilation access ports.

It will often be desirable to add additional ventilation access ports. In the example shown, three bore holes 66 are added. Two of these are immediately adjacent to the combustion face. The term "immediately adjacent to" means that these holes are close enough to the combustion face so that liquid carbon dioxide injected through these bore holes will promptly be converted to gas by the heat of the combustion face. It is preferable that liquid carbon dioxide injected through these bore holes actually impinge upon a portion of the combustion face.

A flow control device is placed in each of the ventilation access ports. The term "flow control device" means anything that alters the flow through a portal and may in fact simply mean plugging the portal. The term also includes injection heads for injecting gases or liquids and controlled vents for venting gases or liquids.

Gas injection head 70 is placed in ventilation shaft 28. The gas injection head is connected to gaseous carbon dioxide supply 58. Controlled vent 62 is placed in the bore hole 66 lying to the left in the view. A liquid injection head 68 is placed in each of the other two bore holes 66 shown.

The general concepts of the present inventive methods are (1) sealing the defined volume; (2) injecting gaseous carbon dioxide throughout the defined volume while maintaining a positive pressure therein so that no inflow occurs through unknown ventilation access ports; and (3) inundating the combustion face with very cold carbon dioxide gas which is delivered as pressurized liquid.

The process is monitored—preferably at multiple locations. The injection heads shown in FIG. 5 regulate flow into the sealed volume. Controlled vent 62 regulates flow out of the sealed volume in order to maintain the desired pressure. Monitor 64 measures the pressure, temperature, and gas composition at the point of exit. It is preferable to use relatively pure carbon dioxide for the gas going into the mine. The coal fire itself produces carbon dioxide but the coal fire combustion products will contain other gases (such as sulfur). Thus, monitoring for carbon dioxide as controlled vent 62 may not provide much useful information. However, if relatively pure carbon dioxide is pumped into the mine then monitoring for coal combustion products (such as sulfur) will provide useful information as to the ongoing combustion at the site of the coal fire itself.

It is preferable to change the conditions in a controlled manner. As one example, it is not desirable to increase the pressure within the mine while a significant amount of oxygen remains. Thus, the pressure is generally increased only after the oxygen is largely displaced by carbon dioxide gas.

A key feature of the present invention is the preferred use of liquid carbon dioxide. Carbon dioxide has no liquid state below a pressure of 5.1 atm. Thus, the liquid carbon dioxide must be maintained in a state above 5.1 atm. Liquid injection heads 68 feed the liquid carbon dioxide down the boreholes. When released from the injection head the pressure drops immediately to the pressure within the mine (typically 1.02 to 1.15 atmospheres). This causes the liquid to change phases rapidly into a gas. In so doing it absorbs a tremendous amount of heat from the surrounding solids and gases.

In some instances it will be possible to lower the liquid injection heads far down into the bore hole (and even in close proximity to the combustion face itself). It is preferable to maintain the carbon dioxide as a liquid right up until the time it is introduced to the combustion face. This way the heat absorbed in the phase change comes from the combustion face itself.

The injection of the liquid carbon dioxide thereby creates a twofold effect. First, the phase change of the carbon dioxide absorbs a tremendous amount of heat from the combustion face and preferably lowers the combustion face below the ignition temperature of the coal. Second, the cold carbon dioxide gas present after the phase change smothers the fire and inhibits any further combustion.

Figure 3:
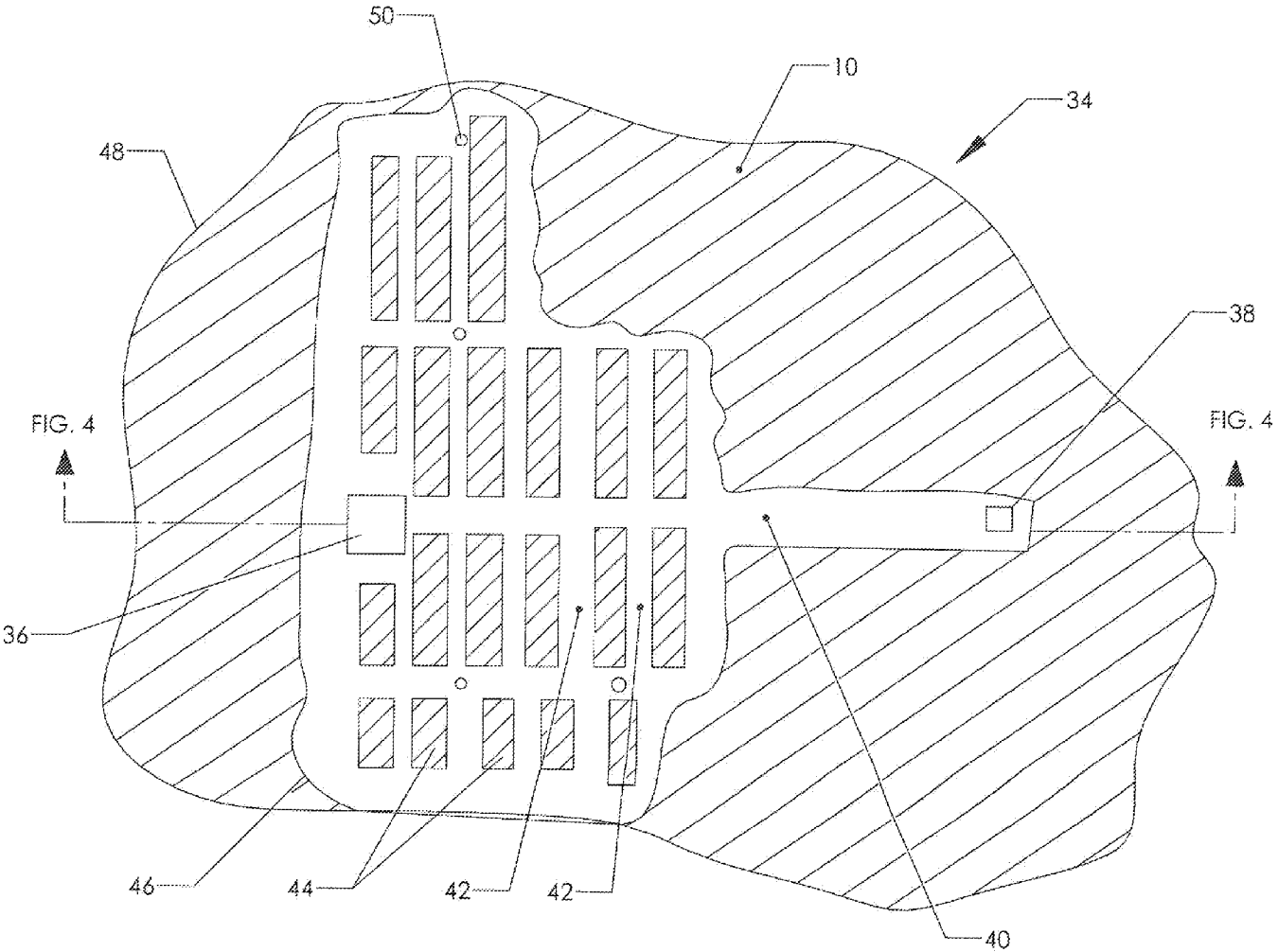
FIG. 3 (PRIOR ART)
FIG. 3 is a plan view showing a subterranean coal mine.
Figure 4:
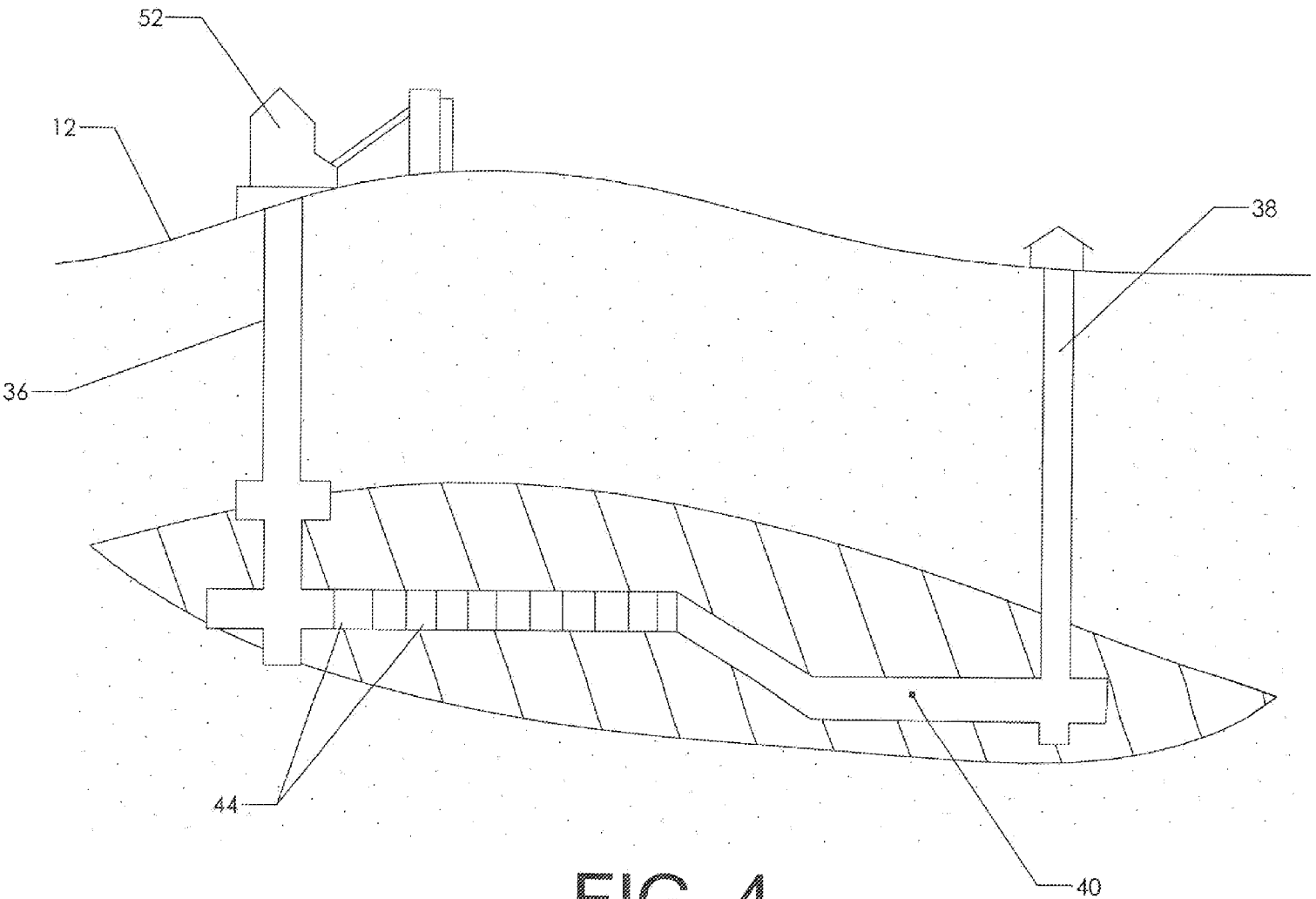
FIG. 4 (PRIOR ART)
FIG. 4 is a sectional elevation view, showing the coal mine of FIG. 3.
Figure 6:
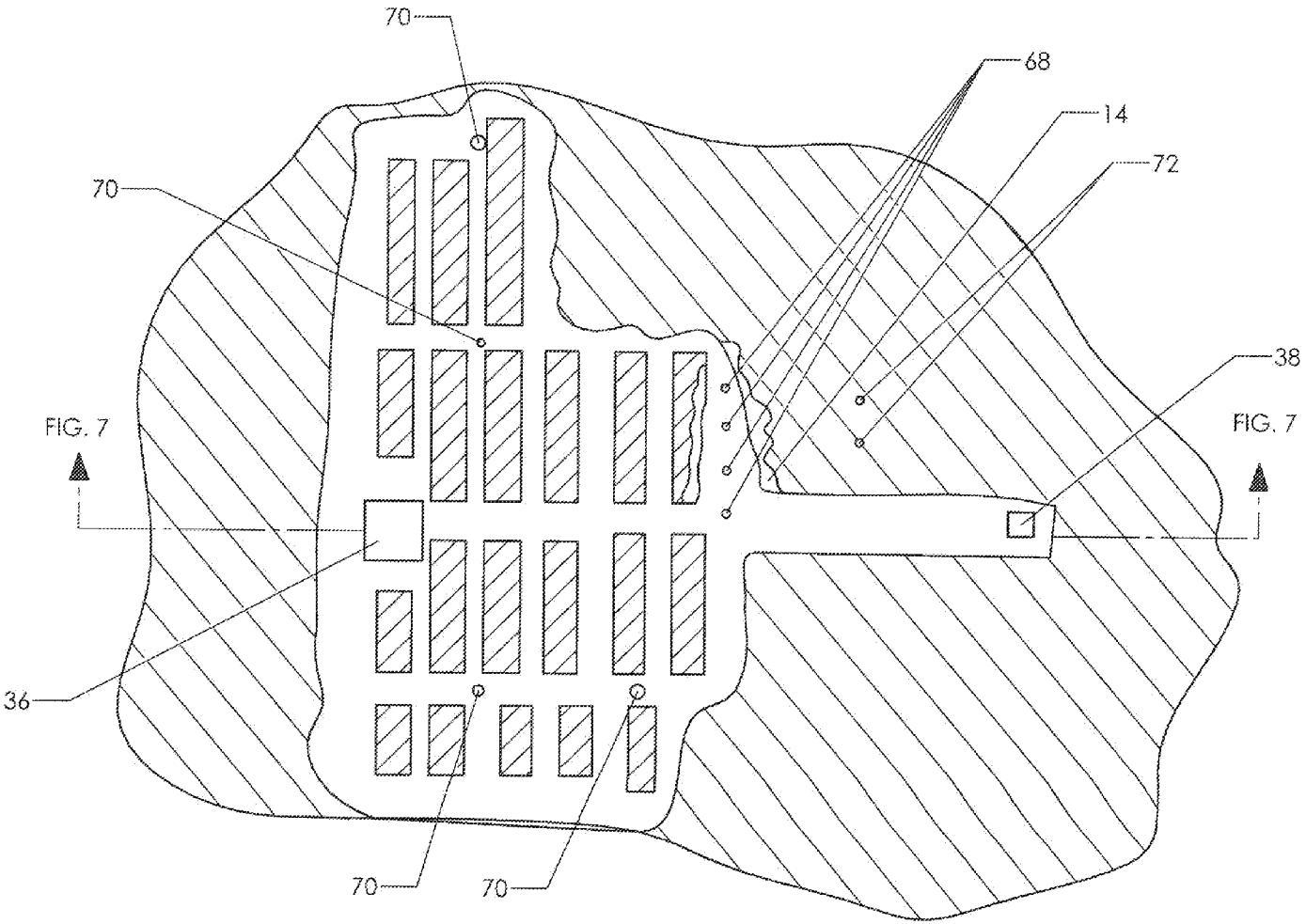
FIG. 6 is a plan view, showing the application of the present invention to a subterranean coal fire in the mine depicted in FIGS. 3 and 4.

Most fires occurring within an actual mine will be more complex than the example shown in FIG. 5. FIG. 6 shows a plan view of a room-and-pillar mine as depicted in FIG. 3. In the example of FIG. 6, a fire has broken out. Two combustion faces 14 are present (moving in opposite directions). One combustion face is consuming the wall of the mine while a second combustion face is consuming one of the pillars.

In order to combat such a fire, it will often be necessary to drill multiple bore holes. Gas injection heads 70 can be added to existing ventilation holes. Additional gas injection heads can be added to newly formed bore holes. In this example, four new bore holes are added immediately adjacent to the combustion face and four liquid injection heads 68 are introduced via these holes.

In addition, two or more monitor holes 72 may be added behind the combustion face (into the unburned coal). These monitor holes are used to introduce sensing instruments (primarily sub-surface temperature sensors) which are used to monitor the progress of the extinguishment activity.

Figure 7:
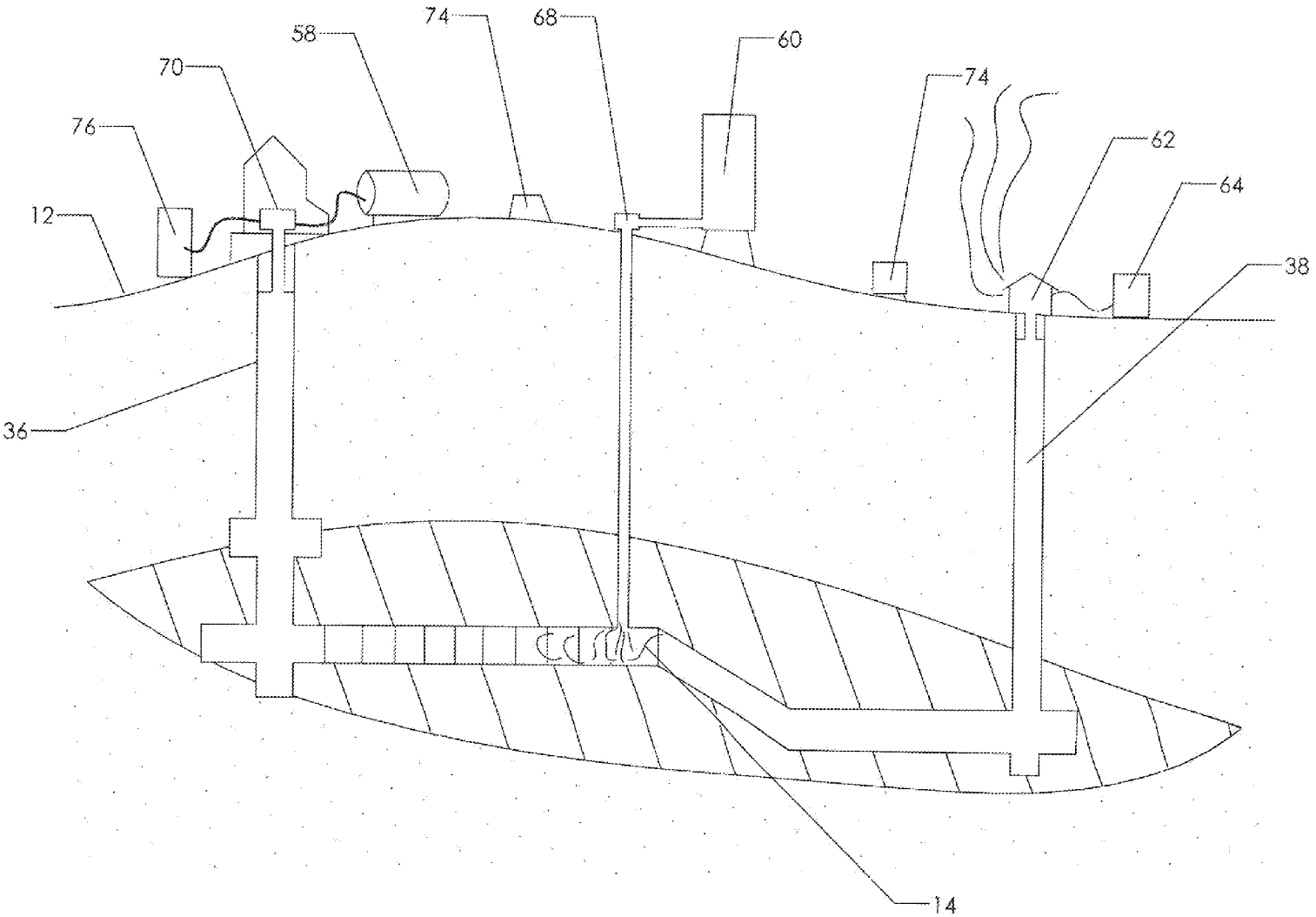
FIG. 7 is a sectional elevation view, showing the application of the present invention to a subterranean coal fire in the mine depicted in FIGS. 3 and 4.

FIG. 7 shows a sectional elevation view of the same configuration depicted in FIG. 6. A gas injection head 70 is placed in main shaft 36. A controlled vent 62 (with attached monitor 64) may be placed in vent shaft 38. One or more surface monitors 74 may also be placed to monitor temperature changes and potential gas emissions. Sub-surface temperature sensors are also preferably provided.

Purge pump 76 is optionally provided. Its purpose is to evacuate gas from portions of the mine at a rate that is greater than that simply produced by the overpressure within the mine. The combination of gas injection heads, controlled vents, and purge pumps can be controlled to produce a desired flow of gas through the mine.

Liquid carbon dioxide is injected while the mine remains saturated in gaseous carbon dioxide. The temperatures in the vicinity of the combustion face are monitored. The liquid injection may cease when it is clear that the fire has been extinguished. However, the carbon dioxide gas saturation (under the overpressure condition) should continue long after extinguishment as deep coal fires have a tendency to rekindle.

The bore holes and flow control devices will typically be placed in a grid. The depths at which these bore holes enter the mine may also need to be varied (as most mines have more than one level).

The preceding description contains significant detail, but it should not be construed as limiting the scope of the invention but rather as providing illustrations of the preferred embodiments of the invention. Many variations will occur to those skilled in the art, particularly as actual mines are more complex than the simplified versions shown in the drawings. Thus, the scope of the invention should be fixed by the following claims, rather than by the examples given.

Having described my invention, I claim:

1. A method for controlling subterranean coal fires, comprising:

a. determining a subterranean volume containing said subterranean coal fire;

b. determining a location for a combustion face within said subterranean coal fire;

c. determining a location for each ventilation access port providing access to said subterranean coal fire;

d. adding a flow control device to each ventilation access port;

e. providing a source of gaseous carbon dioxide;

f. providing a source of liquid carbon dioxide;
g. injecting said gaseous carbon dioxide into said subterranean volume;
h. monitoring at least one flow control device and regulating said at least one flow control device in order to maintain a pressure within said subterranean volume which is greater than atmospheric pressure; and
i. injecting said liquid carbon dioxide into said subterranean volume immediately adjacent to said combustion face.

2. A method for controlling subterranean coal fires as recited in claim 1, wherein:
a. said subterranean volume includes at least one natural vent whose exit is unknown; and
b. said injection of said gaseous carbon dioxide is maintained at a rate sufficient to cause gaseous carbon dioxide to flow out said natural vent and thereby prevent ingress of oxygen through said natural vent.

3. A method for controlling subterranean coal fires as recited in claim 1, further comprising:
a. adding a plurality of vents to said subterranean volume:
b. adding a flow control device to each of said added plurality of vents;
c. regulating said flow control devices in order to direct gas flow within said subterranean space.

4. A method for controlling subterranean coal fires as recited in claim 1, further comprising monitoring the temperature, pressure, and gas composition of gas flowing out of said subterranean volume.

5. A method for controlling subterranean coal fires as recited in claim 1, wherein said gaseous carbon dioxide is pure.

6. A method for controlling subterranean coal fires as recited in claim 1, wherein said gaseous carbon dioxide comprises combustion exhaust products.

7. A method for controlling subterranean coal fires as recited in claim 1, wherein at least one of said flow control devices includes a purge pump configured to remove gas at a rate faster than the rate produced by a positive pressure within said subterranean volume.

8. A method for controlling subterranean coal fires as recited in claim 1, further comprising:
a. providing multiple sub-surface temperature monitors; and
b. monitoring said multiple sub-surface temperature monitors.

9. A method for controlling subterranean coal fires as recited in claim 4, further comprising:
a. providing multiple sub-surface temperature monitors; and
b. monitoring said multiple sub-surface temperature monitors.

10. A method for controlling subterranean coal fires as recited in claim 1, further comprising adding a plurality of bore holes into said subterranean volume proximate said combustion face and injecting at least a portion of said liquid carbon dioxide through said plurality of bore holes into said subterranean volume proximate said combustion face.

11. A method for controlling subterranean coal fires, comprising:
a. determining a subterranean volume containing said subterranean coal fire;
b. determining a location for a combustion face within said subterranean coal fire;
c. determining a location for each ventilation access port providing access to said subterranean coal fire;
d. adding a flow control device to each ventilation access port;
e. adding a plurality of bore holes into said subterranean volume proximate said combustion face;
f. providing a source of gaseous carbon dioxide;
g. providing a source of liquid carbon dioxide;
h. injecting said gaseous carbon dioxide into said subterranean volume;
i. monitoring at least one flow control device and regulating said at least one flow control device in order to maintain a pressure within said subterranean volume which is greater than atmospheric pressure; and
j. injecting said liquid carbon dioxide into said subterranean volume through said plurality of added bore holes proximate said combustion face.

12. A method for controlling subterranean coal fires as recited in claim 11, wherein:
a. said subterranean volume includes at least one natural vent whose exit is unknown; and
b. said injection of said gaseous carbon dioxide is maintained at a rate sufficient to cause gaseous carbon dioxide to flow out said natural vent and thereby prevent ingress of oxygen through said natural vent.

13. A method for controlling subterranean coal fires as recited in claim 11, further comprising:
a. adding a plurality of vents to said subterranean volume:
b. adding a flow control device to each of said added plurality of vents;
c. regulating said flow control devices in order to direct gas flow within said subterranean space.

14. A method for controlling subterranean coal fires as recited in claim 11, further comprising monitoring the temperature, pressure, and gas composition of gas flowing out of said subterranean volume.

15. A method for controlling subterranean coal fires as recited in claim 11, wherein said gaseous carbon dioxide is pure.

16. A method for controlling subterranean coal fires as recited in claim 11, wherein said gaseous carbon dioxide comprises combustion exhaust products.

17. A method for controlling subterranean coal fires as recited in claim 11, wherein at least one of said flow control devices includes a purge pump configured to remove gas at a rate faster than the rate produced by a positive pressure within said subterranean volume.

18. A method for controlling subterranean coal fires as recited in claim 11, further comprising:
a. providing multiple sub-surface temperature monitors; an
b. monitoring said multiple sub-surface temperature monitors.

19. A method for controlling subterranean coal fires as recited in claim 14, further comprising:
a. providing multiple sub-surface temperature monitors; and
b. monitoring said multiple sub-surface temperature monitors.

20. A method for controlling subterranean coal fires as recited in claim 11, further comprising monitoring a temperature in at least one of said plurality of bore holes into said subterranean volume proximate said combustion face.

* * * * *